United States Patent [19]

Weltmer, Jr. et al.

[11] Patent Number: 5,028,273

[45] Date of Patent: Jul. 2, 1991

[54] METHOD OF SURFACE CLEANING ARTICLES WITH A LIQUID CRYOGEN

[75] Inventors: William R. Weltmer, Jr., New Providence; Satish S. Tamhankar, Scotch Plains, both of N.J.

[73] Assignee: The BOC Group, Inc., New Providence, N.J.

[21] Appl. No.: 574,414

[22] Filed: Aug. 28, 1990

[51] Int. Cl.[5] ..... B08B 3/04

[52] U.S. Cl. ..... 134/42; 502/22; 502/34

[58] Field of Search ..... 502/22, 34; 134/42

[56] References Cited

U.S. PATENT DOCUMENTS

| | | | |
|---|---|---|---|
| 4,124,528 | 11/1978 | Modell | 502/22 |
| 4,491,484 | 1/1985 | Williams | 134/4 |
| 4,584,140 | 4/1986 | Blewett et al. | 502/34 |

FOREIGN PATENT DOCUMENTS

| | | | |
|---|---|---|---|
| 0031679 | 3/1976 | Japan | 502/34 |

*Primary Examiner*—Theodore Morris
*Assistant Examiner*—Zeinab El-Arini
*Attorney, Agent, or Firm*—Robert I. Pearlman; David M. Rosenblum

[57] ABSTRACT

The present invention provides a method for cleaning articles by removing surface particulate matter from the articles. In accordance with the present invention, the articles are immersed in a bath of liquid cryogen, chemically non-reactive with the articles to be cleaned. Prior to immersion it is necessary to insure that the articles have a sufficiently high temperature above that of the liquid cryogen and during immersion it is also necessary to insure that the articles are immersed at a sufficient rate to insure that the liquid cryogen undergoes film boiling before undergoing nucleate boiling at the surfaces of the articles. The articles are left immersed so that nucleate boiling of the liquid cryogen occurs at the surfaces of the articles. During the nucleate boiling, the surface particulate matter is carried from the articles and into the liquid cryogen bath. After the articles have reached thermal equilibrium with the liquid cryogen, the articles are removed from the bath. The method can be carried out in an atmospheric environment and at room temperature. In accordance with another aspect of the present invention, the articles can be rewarmed to room temperature in a moisture free environment to prevent atmospheric moisture from condensing on the articles.

6 Claims, 1 Drawing Sheet

METHOD OF SURFACE CLEANING ARTICLES WITH A LIQUID CRYOGEN

BACKGROUND OF THE INVENTION

The present invention relates to a method of surface cleaning articles by removing surface particulate matter from the articles. More particularly, the present invention relates to such a method in which the surface particulate matter is removed from the articles by the use of a liquid cryogen.

Unwanted surface particulate matter exists on articles either initially, by virtue of their manufacture, or after manufacture, during packaging, shipment, and use of the articles, by virtue of surface contamination. For instance, a common catalyst consists of pelletized material formed of nickel and silica. After the preparation of such a catalyst, small particles of nickel and silica are found on the surfaces of the pellets. Another example is pelletized adsorbents formed of carbon molecular sieve material, zeolite material, and etc. Often, such pelletized adsorbent is formed with small particles of the adsorbent clinging to the surfaces of the pellets. Additionally, small mechanical components, such as found in clockwork mechanisms and the like, gather particulate contaminants on their surfaces during use.

The surface particulate material is unwanted in the case of catalysts and adsorbents because when the adsorbent or catalyst is in use, the surface particulate matter can eventually plug valves, filters, etc. It goes without saying that surface particulate matter must be removed from mechanical components of mechanisms in order to insure the continued working of such mechanisms.

In the prior art, pelletized catalyst and adsorbent materials are cleaned by bed fluidization. In bed fluidization, a gas is sent through a bed containing such pelletized materials. The small surface particulate matter normally rises higher than the larger pellets to allow the particulate matter to be collected at the top of the bed in a bag house. Pelletized materials are also cleaned by shaking the materials over a screen. This latter method is ineffective and can damage the articles to be cleaned. Another prior art method of cleaning adsorbents, catalysts, as well as small mechanical components, is with solvents such as water. One problem here is that it is often difficult to dry the article after cleaning the article. Additionally, some adsorbents and catalysts may be damaged by solvents.

As contrasted with the prior art, the present invention provides a method of removing surface particulate matter from articles that is simpler, causes less damage, and is less expensive than prior art cleaning techniques and additionally, does not utilize solvents such as water.

SUMMARY OF THE INVENTION

The present invention provides a method of surface cleaning articles by removing surface particulate matter from the articles. In accordance with the present invention, a bath of a liquid cryogen. The liquid cryogen has a boiling point temperature below that of the articles so that upon contact with the articles, the liquid cryogen will first undergo film boiling and then will undergo nucleate boiling at the surfaces of the articles. The articles are immersed in the bath of the liquid cryogen so that the articles are submerged.

During immersion, it is insured that the articles are immersed at a sufficient rate such that film boiling of the liquid cryogen occurs at the surfaces of all of the articles before nucleate boiling of the liquid cryogen occurs at the surfaces of any one of the articles. The articles are left immersed so that nucleate boiling of the liquid cryogen occurs at the surfaces of all the articles. During the nucleate boiling period, the surface particulate matter is carried from the surfaces of the articles and into the bath of the liquid cryogen. During the immersion of the articles in the liquid cryogen, the conveyance means are supported so that the articles are spaced above the bottom of the bath in order that the surface particulate matter carried from the articles falls to the bottom of the bath. The articles are then removed from the liquid cryogen after they have reached thermal equilibrium with the liquid cryogen.

In the event that the method is carried out in an atmospheric environment, after the articles are removed from the liquid cryogen, atmospheric moisture will condense on the outer surface of the articles as the articles warm to room temperature. This is undesirable for articles that are sensitive to moisture as well as articles that are difficult to dry such as pelletized catalysts and sieving materials. In order to prevent such moisture condensation, an environment is prepared that is essentially free of moisture and the articles are allowed to warm in such environment to prevent the condensation of moisture on the articles.

BRIEF DESCRIPTION OF THE DRAWINGS

While the specification concludes with claims particularly pointing out the subject matter that applicants regard as their invention, it is believed that the invention will be better understood from the following description taken in conjunction with the accompanying drawings in which:

DETAILED DESCRIPTION

Figure 1:
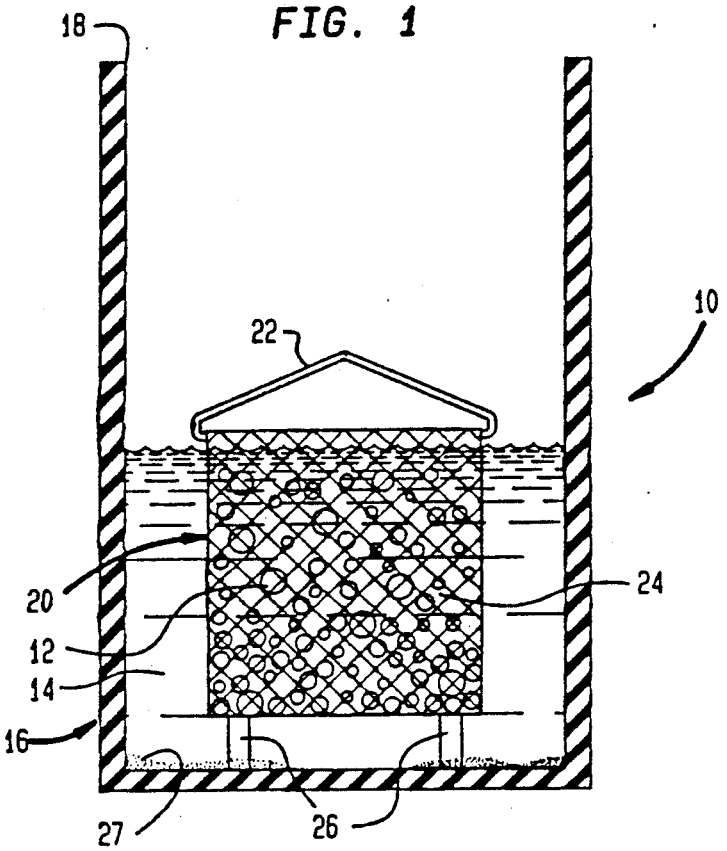
FIG. 1 illustrates a conveyance basket and a sectional view of a liquid cryogen bath used in carrying out a method in accordance with the present invention.

With reference to the Figures, an Apparatus 10 is provided for surface cleaning articles 12 by removing surface particulate matter from articles 12 in accordance with the present invention. Apparatus 10 comprises a liquid cryogen 14 contained within insulated receptacle 16 having a top opening 18 to form a bath of liquid cryogen. Liquid cryogen 14 can comprise any liquid cryogen that is chemically non-reactive with articles 12 to be cleansed. Preferably, liquid cryogen 14 comprises nitrogen because it is essentially chemically inert and is inexpensive as contrasted with other cryogens, namely, argon. Although liquid oxygen could be used, its use would be dangerous due to its chemically reactive nature.

The articles are conveyed to and from insulated receptacle 16 through top opening 18 thereof by means of a wire-mesh conveyance basket 20 having a handle 22. The wire-mesh should be selected so that articles 12 are prevented from falling through the openings 24 formed between the wires of the basket, while at the same time permitting cryogen 14 to enter the interior of conveyance basket 20, from the sides and bottom thereof, in order to surround articles 12. As may be appreciated by those skilled in the art, conveyance basket 20 could be formed from perforated metal sheet material. Additionally, in place of conveyance basket 20 and insulated receptacle 16, a perforated conveyance belt running through an insulated trough might be used in order to carry out the method of the present invention in a continuous manner.

Figure 2:
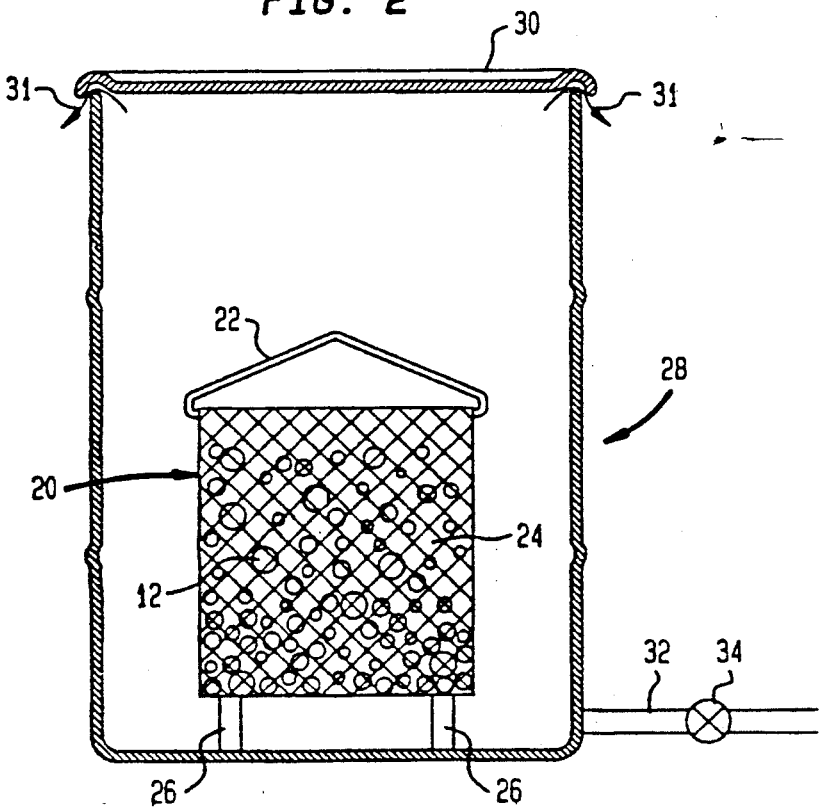
FIG. 2 illustrates the conveyance basket and a sectional view of a container having a moisture free environment used in carrying out a method in accordance with the present invention.

In accordance with the present invention, conveyance basket 20 and therefore, articles 12 are immersed into liquid cryogen 14 so that articles 12 are submerged in liquid cryogen 14. The method of the present invention can be carried out in ambient atmospheric conditions. As such, the articles have an initial temperature of about room temperature, commonly about 294 degrees K. When the articles are immersed in the liquid cryogen such as liquid nitrogen having a temperature of about 77 degrees K, film boiling of the liquid cryogen first occurs at the outer surfaces of articles 12 and thereafter, nucleate boiling of the liquid cryogen occurs at the surfaces of articles 12. During the nucleate boiling, the surface particulate matter, designated by reference numeral 27, is carried from the articles and through openings 24 of conveyance basket 20 and into liquid cryogen 14. Surface particulate matter 27 then falls to the bottom of insulated receptacle 16. In this regard, conveyance basket 20 is provided with three or more legs 26. In the preferred embodiment, conveyance basket 20 is provided with four legs 26 (of which only two can be seen in the views of FIGS. 1 and 2) to support conveyance basket 20 so that articles 12 are spaced above the bottom of insulated receptacle 16. Such support of conveyance basket 20 allows liquid cryogen 14 to contact the underside of the lowermost of articles 12; and also allows surface particulate matter 27 to collect at the bottom of insulated receptacle 16 and thus, at a distance from articles 12. It is to be noted that the method of the present invention is particularly advantageous in the cleaning of noble metal catalysts, such as platinum because surface particulate matter 27 can be recovered from the bottom insulated receptacle 16 at a later time. After the nucleate boiling ceases, that is articles 12 are in thermal equilibrium with cryogen 14, conveyance basket 20, and therefore articles 12, are removed from insulated receptacle 16 through top opening 18 with the use of handle 22.

In accordance with the method of the present invention, it is important for film boiling to occur at the outer surfaces of all the articles before nucleate boiling occurs at the outer surfaces of any one of the articles. For instance, if nucleate boiling occurs at the articles at the bottom of conveyance basket 20 before film boiling occurs at the articles situated at the top of conveyance basket 20, the on-rush of gas within conveyance basket 20 can drive the surface particulate matter upwards so that the articles centrally located in basket 20 are not cleaned or are covered with a deposit of surface particulate matter greater than that covering their surfaces prior to the performance of the method in accordance with the present invention. This can occur by immersing basket 20 and therefore articles 12 into liquid cryogen 14 at too slow a rate.

In addition to the foregoing, the aforementioned sequence of film boiling followed by nucleate boiling will not occur in the event that articles 12 are at too low an initial temperature prior to immersion in the bath of liquid cryogen. As mentioned previously, it is contemplated that the method of the present invention will normally be carried out at room temperature with articles 12 having an initial temperature of room temperature. Thus, in the normal practice of the present invention, there will be enough of a temperature spread between the initial temperature of articles 12 and a liquid cryogen, such as nitrogen, to produce film boiling of the liquid cryogen at the surfaces of all of articles 12 before the liquid cryogen undergoes nucleate boiling at the surfaces of any one of articles 12 if articles 12 are promptly immersed as indicated above. However, it is possible to conduct the method of the present invention at lower temperatures, but no less than about 200 degrees K. Alternatively, it is also possible that the method of the present invention could be conducted as an adJunct to another process in which articles 12 have an initial temperature of below 200 degrees K. In such case, articles 12 would have to be warmed to a temperature of above 200 degrees K. in order to insure that the initial temperature of the articles is sufficient to produce the sequence of film boiling followed by nucleate boiling, noted above.

As mentioned previously, many materials are difficult to dry or are sensitive to moisture. When basket 20, and therefore articles 12, are removed from liquid cryogen 14 and insulated receptacle 16, atmospheric moisture will tend to condense on the outer surfaces of the articles. In order to prevent this, after removal of conveyance basket 20 from insulated receptacle 16, conveyance basket 20 is positioned within a container 28 having a loose fitting lid 30. In case of porous materials, such as zeolite and carbon molecular sieve material, as articles 12 rewarm to room temperature, the gaseous form of cryogen 14 will desorb from articles 12, fill container 28, and seep out of container 28 beneath lid 30 as indicated by arrows 31. This will produce a dry atmosphere within container 28 essentially free of air and therefore moisture contained within the air. As a result, as articles 12 warm to room temperature, there will be no condensation on the surfaces of articles 12. In case articles 12 have mirror-like surfaces which are not porous and are not easily wetted, an inlet pipe 32 may optionally be provided in the bottom of container 28 for the entry of dry, gaseous materials, such as nitrogen or dry air at pressures above atmospheric pressure, upon the opening of an inline valve 34. In a like manner to described nitrogen producing the moisure free environment, the gaseous nitrogen or dry air would displace the atmospheric air by seeping out of container 28 beneath lid 30 to produce a moisture free environment in which articles 12 can warm without condensation of atmospheric moisture.

It is appropriate to point out that conveyance basket 20 should be removed from insulated receptacle 16 at a slow enough rate to permit liquid cryogen 14 to drain from conveyance basket 20 and back into the bath of liquid cryogen in order to prevent loss of liquid cryogen 14. However, in case the method of the present invention is carried out in an atmospheric environment, then such slow removal rate can cause atmospheric moisture to condense on articles 12. In order to prevent this, insulated receptacle 16 should be high enough so that when conveyance basket 20 is fully removed from liquid cryogen 14, conveyance basket 20 will be below the level of top opening 18 of insulated receptacle 16. The space between top opening 18 and the top surface of liquid cryogen 14 will in itself form another moisture free environment in which liquid cryogen 14 may drain from conveyance basket 20 because of boiled off cryogen filling and thereby displacing air from such space.

As may be appreciated, in the event that loss of liquid cryogen 14 is of no importance, the foregoing may be omitted in carrying out the method of the present invention.

Although preferred embodiments have been shown and described in detail, it will be readily understood and appreciated by those skilled in the art that numerous omissions, changes, and additions may be made without departing from the spirit and scope of the invention.

We claim:

1. A method for cleaning articles by removing surface particulate matter from the articles, said method comprising:

immersing the articles into a bath of a liquid cryogen within which the liquid cryogen first undergoes film boiling and then undergoes nucleate boiling at the surfaces of the articles due to a temperature spread between cryogen boiling point temperature and article temperature upon immersion and the surface particulate matter is carried from the articles during the nucleate boiling of the liquid cryogen; and removing the articles from the bath of the liquid cryogen after the articles have reached thermal equilibrium with the liquid cryogen;

the articles being immersed at a sufficient rate so that film boiling of the liquid cryogen occurs at surfaces of all articles before nucleate boiling of the liquid cryogen occurs at the surfaces of any one of the articles; and the articles being supported while immersed in the bath of the liquid cryogen so that the articles are above the bottom of the bath of the liquid cryogen and therefore, the surface particulate matter falls clear of the articles.

2. The method of claim 1, further comprising:

preparing an environment essentially free of moisture;

conveying the articles from the bath of the liquid cryogen into the essentially moisture-free environment after the articles are removed from the bath of the liquid cryogen; and warming the articles in the essentially moisture-free environment so that moisture will not condense on the outer surfaces of the articles.

3. The method of claim 2, wherein:

the articles comprise porous pelletized material that absorbs the liquid cryogen;

the essentially free moisture environment is formed within a container at atmospheric temperature;

the articles are placed within the container; and the container is covered with a loose fitting lid, whereby as the articles warm, gaseous cryogen desorbs from the pelletized material, fills the container, and seeps out of the container beneath the lid to produce the essentially moisture-free environment within the container within which the articles can warm to atmospheric temperature.

4. The method of claim 2, wherein:

the articles have mirror-like surfaces which are nonporous and are not wetted;

the essentially moisture free environment is formed within a container having a bottom opening for entry of a dry gas having a pressure above atmospheric pressure;

the dry gas is sent into the container, through the bottom opening thereof;

the articles are placed within the container; and the container is covered with a loose fitting lid, whereby the dry gas fills the container and seeps out of the container beneath the lid to form the essentially moisture-free environment within the container.

5. The method of claim 1, further comprising preparing the bath of the liquid cryogen by pouring liquid nitrogen into an insulated receptacle.

6. The method of claim 1, wherein:

the article temperature prior to immersion is not sufficient to produce the temperature spread between cryogen boiling point temperature and the article temperature upon immersion required to serially effect the film boiling followed by the nucleate boiling of the liquid cryogen; and wherein the method further comprises heating the articles prior to immersion to a temperature sufficiently above the cryogen boiling point temperature so that upon immersion, the article temperature will be sufficient to produce the temperature spread required to serially effect the film boiling followed by the nucleate boiling of the liquid cryogen.

* * * * *